United States Patent [19]

Dart et al.

[11] Patent Number: 4,582,214

[45] **Date of Patent: * Apr. 15, 1986**

[54] NON-SPILL DRINK-THROUGH LID

[75] Inventors: William A. Dart; Kenneth B. Dart, both of Okemos, Mich.

[73] Assignee: Dart Container Corporation, Mason, Mich.

[ * ] Notice: The portion of the term of this patent subsequent to Nov. 1, 2000 has been disclaimed.

[21] Appl. No.: 547,018

[22] Filed: Oct. 31, 1983

Related U.S. Application Data

[63] Continuation-in-part of Ser. No. 317,789, Nov. 4, 1981, Pat. No. 4,412,629.

[51] Int. Cl.[4] ..... A47G 19/22; B65D 21/02

[52] U.S. Cl. ..... 220/90.4; 206/508; 229/7 R; 220/254

[58] Field of Search ..... 220/90.2, 90.4; 229/7 R; 206/508

[56] References Cited

U.S. PATENT DOCUMENTS

| | | | |
|---|---|---|---|
| 4,081,103 | 3/1978 | Zoellick | 229/7 R |
| 4,127,212 | 11/1978 | Waterbury | 220/90.4 |
| 4,206,854 | 6/1980 | Takami | 206/508 |
| 4,210,256 | 7/1980 | Amberg | 220/90.4 |
| 4,350,260 | 9/1982 | Prucher | 220/90.4 |
| 4,394,928 | 7/1983 | Philip | 220/90.4 |

*Primary Examiner*—George E. Lowrance

*Attorney, Agent, or Firm*—Miller, Morriss & Pappas

[57] ABSTRACT

A non-spill drink-through lid is provided with a retainer support wall defined in a chord position across the central cover portion thereof. The retainer support wall merges with the raised outer peripheral edge of the lid to define a well portion which encompasses a depressible tab portion defined by a slit provided in the central cover portion. The well portion is adapted to retain excess liquid above the slit so as to permit the excess liquid to drain back into the interior of the cup upon which the lid is mounted. Another embodiment of the invention consists of the non-spill drink-through lid having a pair of identical parallel spaced-apart cup support walls defined in the central cover portion of the lid and extending thereacross to merge at the ends thereof with the raised outer peripheral edge of the lid. Thus positioned, the cup support walls are adapted to stackably support another cup positioned thereon.

3 Claims, 19 Drawing Figures

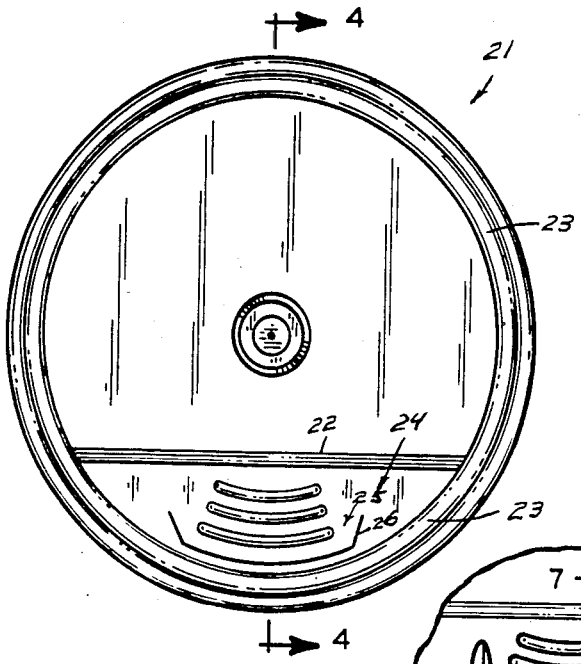
FIG. 1
FIG. 2
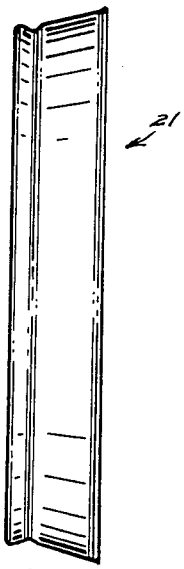
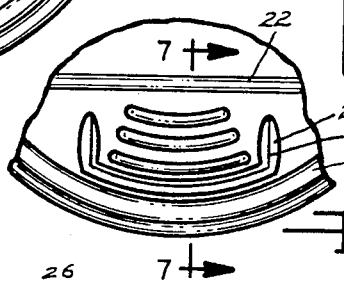
FIG. 6
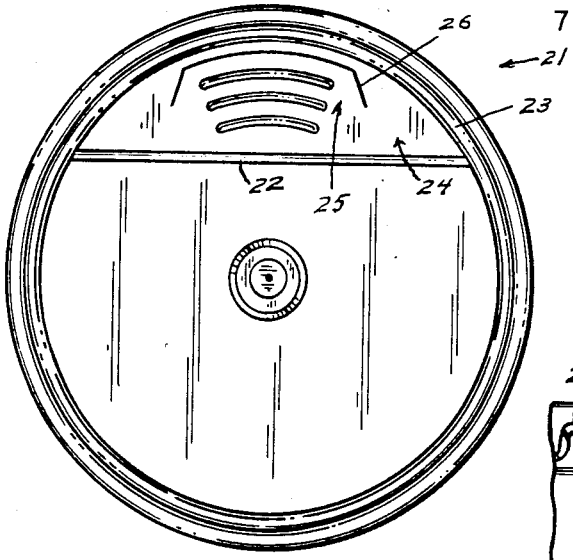
FIG. 3
FIG. 5
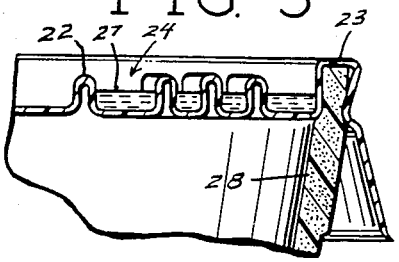
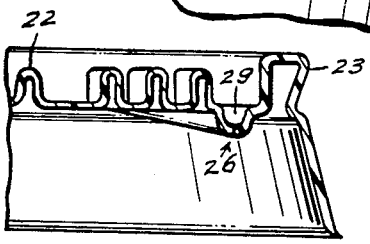
FIG. 7
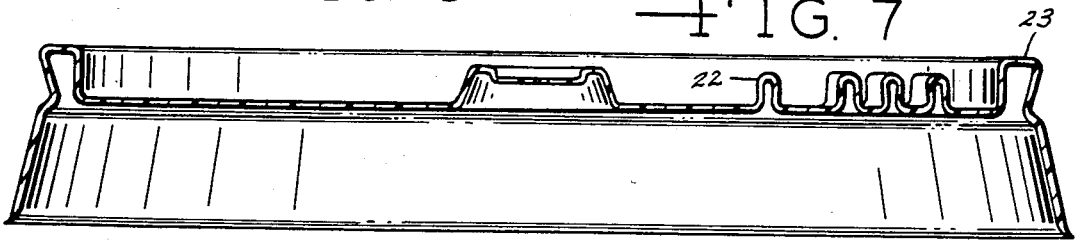
FIG. 4

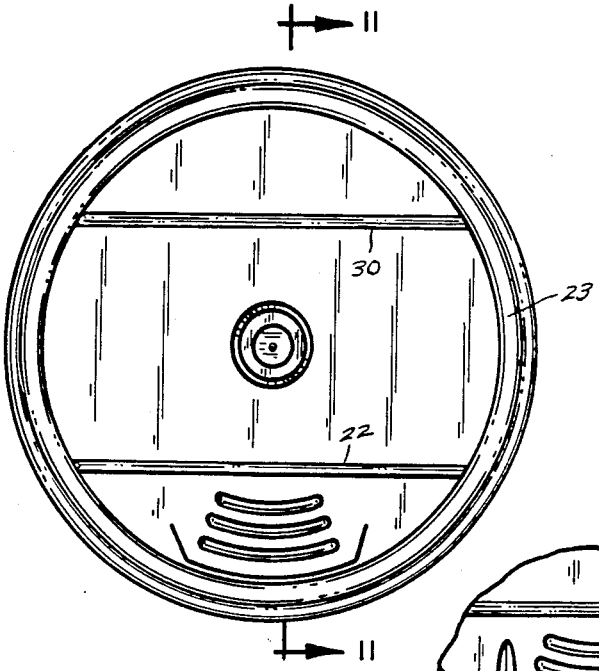
FIG. 8
FIG. 9
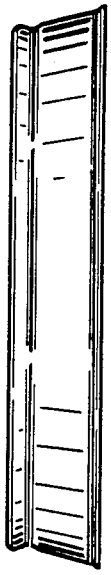
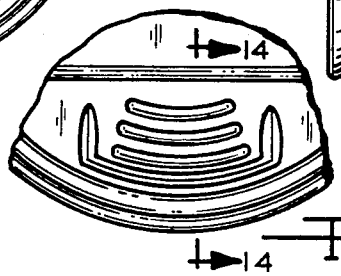
FIG. 13
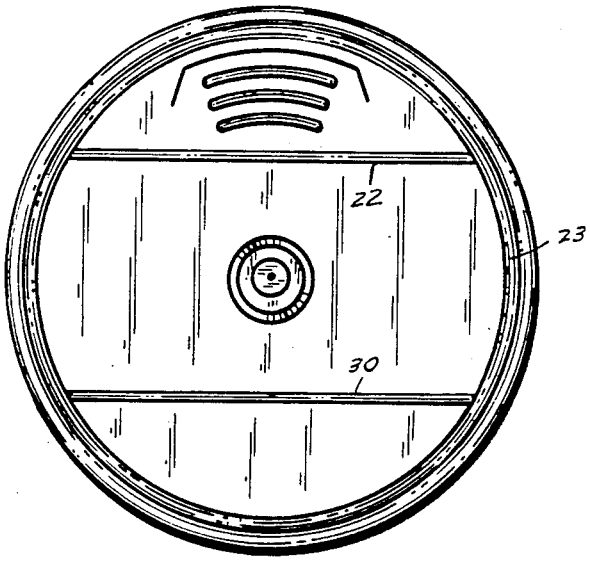
FIG. 10
FIG. 12
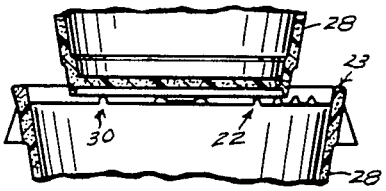
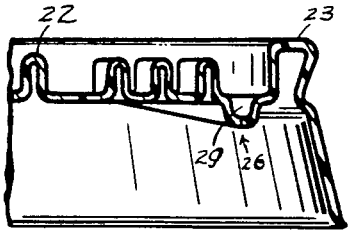
FIG. 14
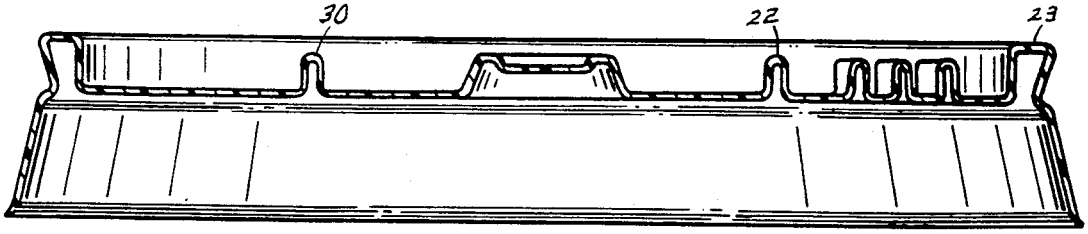
FIG. 11

NON-SPILL DRINK-THROUGH LID

This application is a continuation-in-part application from the pending U.S. patent application Ser. No. 317,789, filed on Nov. 4, 1981, and now U.S. Pat. No. 4,412,629 issued on Nov. 1, 1983.

This invention relates to an improved non-spill drink-through lid for use on a drinking cup.

More specifically, the improved lid is provided with an overflow well portion defined in the upper portion thereof which is adapted to retain overflow liquid from spreading over the entire lid surface. Further, another embodiment of the invention provides a pair of spaced-apart wall portions defined in the upper surface of the lid and extending upwardly therefrom at an equal height so as to provide support for the bottom of a full cup stacked thereon when the lid is in its operative use position on a cup.

As described and disclosed in great detail in the pending parent patent application (U.S. Pat. No. 4,412,629), the non-spill drink-through lid is provided with a tab portion defined in the lid which is selectively depressible so as to provide a drinking opening through the lid. The tab portion is biased to return to its normally closed position within the plane of the lid upon removal of lip pressure thereagainst.

It has been subsequently found that when the lid is in actual use, a residual amount of liquid remains on the upper surface of the lid after the user has taken a sip through the lid and has removed the cup from his mouth. The excess overflow liquid has been found to spread over the entire upper surface of the lid so as to create a problem of spillage over the edge of the lid when the lid is tilted toward the user during the next sipping or drinking action by the user. In order to eliminate this problem, the improved lid is provided with a retainer support wall defined in a chord position across the upper surface of the lid so as to cooperate with the raised peripheral edge wall of the lid to provide a well portion which encompasses the aforementioned selectively depressible tab portion. Thus, after the user has finished sipping liquid through the lid and has returned the cup to a horizontal position, any excess liquid remaining on the upper surface of the lid is retained in the well portion so as to be positioned directly above the slit opening which forms the selectively depressible tab portion. Thus positioned, the excess liquid will drain back into the interior of the cup upon which the lid is mounted. Such action is possible because in use the tab portion does not provide a water tight seal when it returns to its normally closed position upon removal of the lip pressure thereagainst.

Another embodiment of this invention provides a channel portion defined in the lid along the slit opening so that the slit opening slopes downwardly toward the outer peripheral edge of the lid. This configuration enhances the drainage of the excess liquid back into the interior of the cup upon which the lid is mounted.

It has also been found that it is desirable to provide an improved lid which has the capability to support another full cup thereon when the lid is in its operative use position upon a full cup. This capability permits the vertical stacking of full cups to facilitate handling by users prior to drinking action therefrom. This stacking capability is achieved by providing a pair of parallel spaced-apart support walls of equal height which are defined in the upper portion of the lid so as to extend across the lid from the outer raised peripheral edge of the lid. Thus positioned, the upper edges of the parallel spaced-apart wall portions provide a stable support for the bottom of a full cup stacked thereon when the lid is in its operative use position on a cup. It is within the scope of this invention that the spaced-apart support walls can be selectively utilized on non-spill drink-through lids provided with selectively depressible tab portions or with standard lids which do not have the sip-through feature but which require the stackable capability provided thereby.

It is therefore an object of this invention to provide an improved non-spill drink-through lid having a well portion defined in the upper surface thereof which encompasses the depressible tab portion thereof so as to retain excess liquid directly over the slit forming the depressible tab portion so as to enhance the drainage of the excess liquid back into the interior of the cup upon which the lid is mounted.

Another object of this invention is to provide an improved non-spill drink-through lid and/or standard lid having a pair of parallel spaced-apart support walls of equal height defined on the upper surface of the lid so as to provide support for another full cup stackably mounted thereon.

Other objects and advantages found in the construction of the invention will be apparent from a consideration of the following specification in connection with the appended claims and the accompanying drawings.

IN THE DRAWINGS

FIG. 1 is a top view of the improved non-spill drink-through lid showing the support wall provided in a chord position across the upper surface of the lid so as to cooperate with the outer peripheral edge of the lid to form a excess liquid retainer well which encompasses the depressible tab portion of the lid.

FIG. 2 is a side view thereof.

FIG. 3 is a bottom view thereof.

FIG. 4 is a cross-sectional view thereof taken on line 4—4 of FIG. 1.

FIG. 5 is a partial schematic cross-sectional view of the improved lid in its operative use position on a cup and showing excess liquid retained in the retainer well formed by the raised support wall and the raised outer peripheral edge of the lid.

FIG. 6 is a partial schematic top view of another embodiment of the lid showing a depressed downwardly sloping channel portion along the slit forming the depressible tab portion.

FIG. 7 is a cross-section view thereof taken on line 7—7 of FIG. 6.

FIG. 8 is a top view of another modified embodiment of the improved non-spill drink-through lid showing a pair of spaced-apart support walls defined in the upper surface of the lid.

FIG. 9 is a side view of the embodiment of the invention shown in FIG. 8.

FIG. 10 is a bottom view of the embodiment shown in FIG. 8.

FIG. 11 is a cross-sectional view of the embodiment of the invention as taken on line 11—11 of FIG. 8.

FIG. 12 is a partial schematic cross-sectional view of the modified embodiment of the invention shown in FIG. 8 in its operational use position on a cup with another cup stackably mounted thereon.

FIG. 13 is a partial schematic top view of another modified embodiment of the invention shown in FIG. 8 showing a depressed downwardly sloping channel portion along the slit forming the depressible tab portion.

FIG. 14 is a cross-sectional view thereof taken on line 14—14 of FIG. 13.

Figure 15:
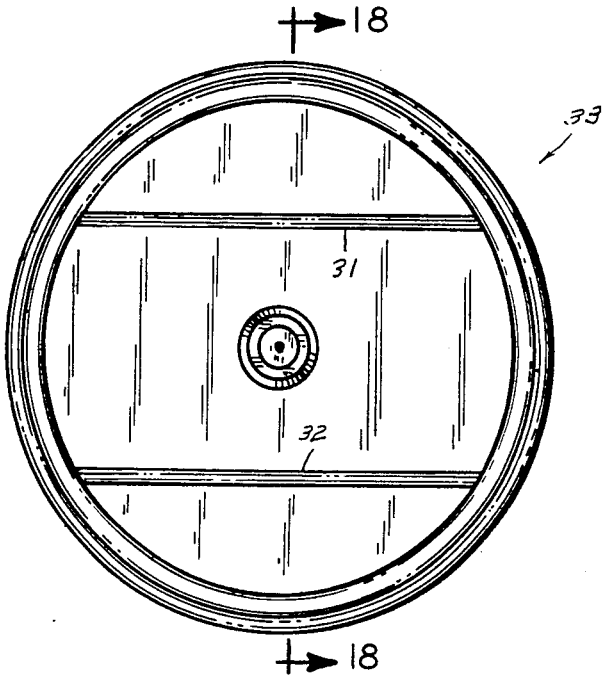

FIG. 15 is a top view of another modified embodiment of the invention showing a pair of spaced-apart cup support walls defined in the upper surface of a standard cup lid.

Figure 16:
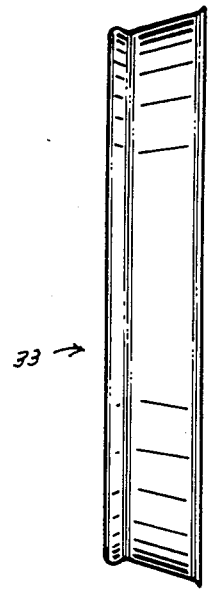

FIG. 16 is a side view of the modified embodiment of the invention as shown in FIG. 15.

Figure 17:
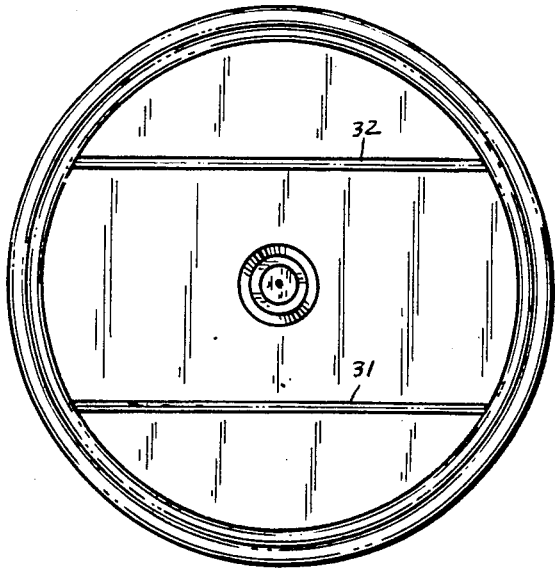

FIG. 17 is a bottom view of the modified embodiment of the invention as shown in FIG. 15.

Figure 18:
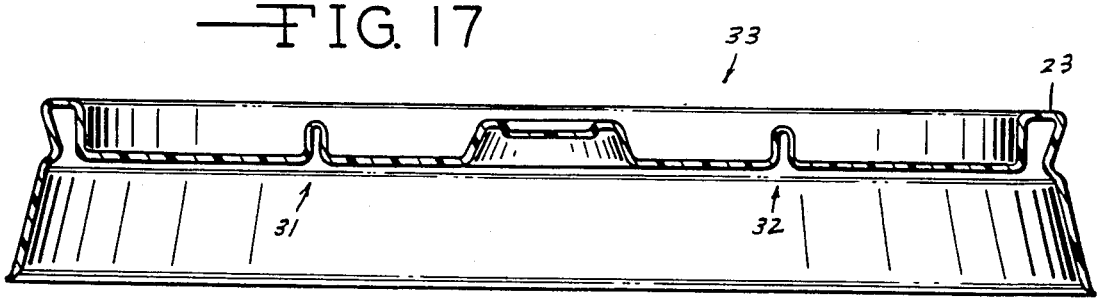

FIG. 18 is a cross-sectional view of the modified embodiment of the invention as taken on line 18—18 of FIG. 15.

Figure 19:
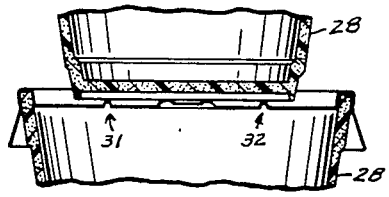

FIG. 19 is a partial schematic cross-sectional view of the modified embodiment of the invention shown in FIG. 15 in its operational use position on a cup with another cup stackably mounted thereon.

DESCRIPTION

As shown generally in the drawings and more specifically in FIG. 1, an improved non-spill drink-through lid 21 is provided with a retainer support wall 22 defined in a chord position across the upper surface of the lid 21 so as to cooperate with the raised outer peripheral edge 23 of the lid 21 to form an excess liquid well portion 24 as shown in greater detail in FIGS. 4 and 5. The well portion 24 encompasses the depressible tab portion 25 formed by the substantially U-shaped slit 26. As described in the parent application (Ser. No. 337,789) the depressible tab portion 25 is selectively depressed downwardly by the upper lip of the user so as to form an opening in the lid, thus enabling the user to sip liquid from the tilted cup 28 through the aforementioned opening. As previously stated, when the user is through sipping liquid through the lid, an excess overflow amount of liquid remains all across the upper surface of the lid. This has resulted in undesirable spillage when the user raises and tilts his cup to take another drink. This problem is eliminated by the present invention whereby the excess liquid 27 is retained in the well portion 24 as is clearly shown in FIG. 5. Thus positioned and retained, the excess liquid 27 will slowly drain downwardly into the interior of the cup 28 through the slit 26 while the cup is in its vertical rest position in the hand of the user. This occurs even though the tab portion 25 has returned to its normal horizontal position.

As shown in FIGS. 6 and 7, another embodiment of the invention is provided with a depressed channel portion 29 along which the slit 26 is provided along the lowermost portion of the channel 29. The channel 29 is configured to slope downwardly and outwardly so as to enhance the drainage of the excess liquid into the interior of the cup 28 upon which the lid 21 is mounted.

Yet another embodiment of the invention is specifically shown in FIGS. 8 through 14 wherein a cup support wall 30 is provided in a parallel spaced-apart relationship to the retainer support wall 22. The cup support wall 30 is the same height as the support wall 22 and is positioned in a chord portion located in an equidistant but opposed position from the center of the lid 21.

As shown in FIG. 12, the upper edges of the support walls 22 and 30 are thus adapted to supportably engage the bottom of a cup stackably mounted thereon. Thus, it is possible to stackably carry full cups with a stability heretofore not possible. The improved lid 21 shown in FIGS. 8 through 14 in all other respects functions as disclosed in FIGS. 1 through 7 and in the written description pertaining thereto.

It should be noted that the support walls 22 and 30, taken alone or in combination also structurally enhance the lid so as to impart increased strength thereto. This increases the stacking capability of the lid and also enhances the biasing action of the depressible tab as described in the parent application.

Yet another embodiment of the invention is shown in FIGS. 15 through 19. A pair of parallel spaced-apart support walls 31 and 32, respectively, are similarly formed so as to extend upwardly from a standard lid 33. Here again the support walls 31 and 32, are equal height. As shown in FIG. 19, the upper edges of the support walls 31 and 32 are configured to supportably engage the bottom of a cup 28 stackably mounted thereon. Thus, a structurally enhanced standard lid 33 is provided which is capable of stackably supporting a full cup thereabove when it is in its operative use position on its cup.

In summary, a non-spill drink-through lid for use on a drinking cup is provided. The lid has a central cover portion which is provided with a raised outer peripheral edge adapted to matingly engage the upper peripheral edge of a drinking cup so as to selectively maintain the lid in a covering relationship on the cup. A tab portion as defined by a slit provided in the central cover portion of the lid. The tab portion is selectively depressible so as to provide a drinking opening in the lid. The tab portion is biased so as to selectively return to its normally closed position within the plane of the central cover portion upon removal of lip pressure thereagainst. A retainer support wall is defined in a chord position on the central cover portion. The retainer support wall is adapted to cooperate with the raised outer peripheral edge of the lid so as to define a well portion which encompasses the tab portion so as to retain excess liquid thereabove. In another embodiment of the invention, the slit is provided along the lowermost portion of a downwardly and outwardly sloping channel positioned within the base of the well portion. In still another embodiment of the invention, a second cup support wall is defined in the central cover portion so as to be in a parallel spaced-apart relationship to the retainer support wall. The second cup support wall is of the same height as the retainer support wall. The cup support wall and the retainer support wall are adapted to stackably support a cup positioned thereon. In still another embodiment of the invention, a standard lid for use on a drinking cup is provided having a central cover portion. The standard lid is provided with a raised outer peripheral edge adapted to matingly engage the upper peripheral edge of a drinking cup so as to selectively maintain the standard lid in a covering relationship on the cup. A pair of spaced-apart cup support walls are defined in the central cover portion so as to merge into the raised outer peripheral edge of the lid. The cup support walls are of the same height. Thus positioned, the cup support walls are adapted to stackably support a cup positioned thereon.

Various other modifications of the invention maybe made without departing from the principle thereof. Each of the modifications is to be considered as included in the hereinafter appended claims unless these claims by their language expressly provide otherwise.

We claim:

1. In an improved non-spill drink-through lid for use on a drinking cup comprising a lid having a central cover portion and a raised outer peripheral edge portion, said lid adapted to matingly engage the upper peripheral edge of a drinking cup so as to selectively maintain said lid in a covering relationship on said cup; a tab portion defined in said central cover portion of said lid, said tab portion selectively depressible so as to provide a drinking opening in said lid, said tab portion biased so as to selectively return to its normally closed position within the plane of said central cover portion upon removal of pressure thereagainst; and a hollow lip-engaging buttress member integrally formed in said tab portion, said buttress member configured to provide increased heat-dissipating surfaces thereon so as to insulatively engage the upper lip of a user drinking from said cup through said drinking opening in said lid, said ridges comprising narrow raised portions which define corresponding pockets on the bottom surfaces thereof so as to provide increased heat-dissipating surfaces on said buttress so as to insulatively engage the upper lip of a user drinking from said cup through said drinking opening in said lid, wherein the improvement comprises:

a raised retainer support wall defined in a chord position on said central cover portion so as to extend fully thereacross, said raised retainer support wall merging at each end thereof with said raised outer peripheral edge of said lid, said raised retainer support wall cooperating with said raised outer peripheral edge of said lid to define a well portion which encompasses said tab portion so as to retain excess liquid within said well portion.

2. In the non-spill drink-through lid of claim 1 wherein said split is provided along the lowermost portion of a downwardly and outwardly sloping channel positioned within said well portion.

3. In the non-spill drink-through lid of claim 1 wherein a second cup support wall is defined in said central cover portion so as to be in a parallel spaced-apart relationship to said retainer support wall, said second cup support wall being of the same height as said retainer support wall, said cup support wall and said retainer support wall adapted to stackably support a cup positioned thereon.

* * * * *